United States Patent [19]

Lelong

[11] 4,046,375

[45] * Sept. 6, 1977

[54] ROTATABLE SWING

[76] Inventor: Marion Pasteur Lelong, 1308 Seaton Lane, Falls Church, Va. 22046

[ * ] Notice: The portion of the term of this patent subsequent to Aug. 31, 1991, has been disclaimed.

[21] Appl. No.: 427,059

[22] Filed: Dec. 21, 1973

Related U.S. Application Data

[63] Continuation-in-part of Ser. No. 160,727, July 8, 1971, Pat. No. 3,829,086.

[51] Int. Cl.[2] ..... A63G 9/00

[52] U.S. Cl. ..... 272/85

[58] Field of Search ..... 272/85, 86, 87, 88, 272/89, 90, 91, 54, 55, 56, 33; 297/242, 245, 277, 77; 5/120; 273/DIG. 7

[56] References Cited

U.S. PATENT DOCUMENTS

| | | | |
|---|---|---|---|
| 1,660,139 | 2/1928 | Shellabarger | 272/85 UX |
| 1,687,408 | 10/1928 | Watkins | 272/85 |
| 1,874,345 | 8/1932 | Parrot | 272/85 |
| 1,975,463 | 10/1934 | Jones | 272/85 |
| 2,325,456 | 7/1943 | Williams | 272/85 |
| 2,539,869 | 1/1951 | Sicklesteel | 272/85 |
| 3,058,744 | 10/1962 | McGuire | 272/85 |
| 3,268,223 | 8/1966 | Woodsum, Jr. | 272/33 |
| 3,563,539 | 2/1971 | Rogers | 272/89 |
| 3,580,571 | 5/1971 | Green | 272/85 |
| 3,588,021 | 6/1971 | Wormser | 272/85 X |
| 3,663,016 | 5/1972 | Morris | 272/85 |

*Primary Examiner*—Richard C. Pinkham
*Assistant Examiner*—T. Brown

[57] ABSTRACT

A rotatably interconnected two-seater swing having an aligner means and, in pairs, a stabilizer means, an attachment means, and a position means as a rider assembly. The swing is combined with a seesaw means for inducing endwise swinging. The aligner means may be monoshaft or multishaft. The stabilizer means may be a spreader means or a hanger means, the former being combined with bifurcated tensional support lines, the latter with a single line attached above the center of gravity of a nearby rider. The support lines may be inwardly inclined, upright, or outwardly inclined. The swing travels endwise and sidewise and is capable of describing an apparent figure-eight pattern when the ends of the swing move transpositionally.

24 Claims, 42 Drawing Figures

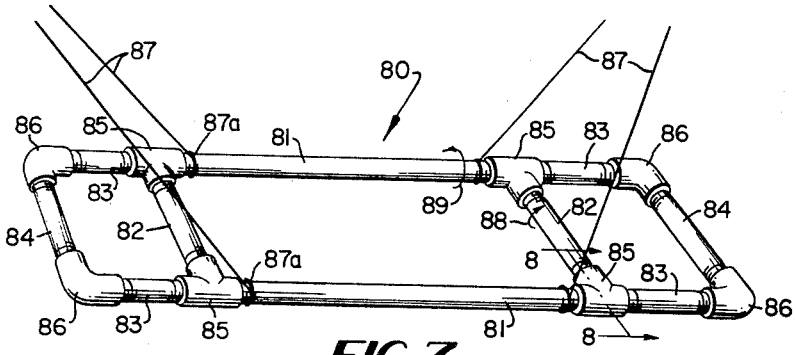
FIG. 7
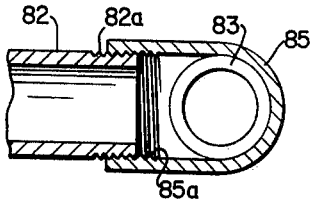
FIG. 8
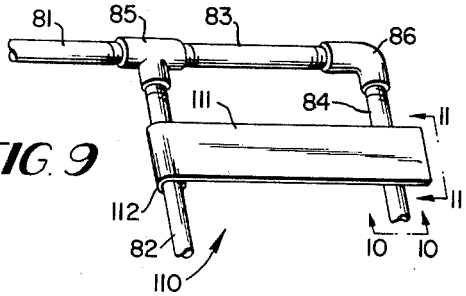
FIG. 9
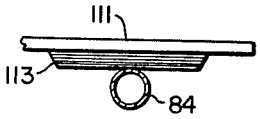
FIG. 10
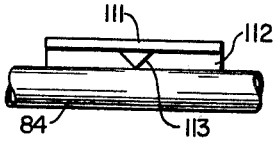
FIG. 11
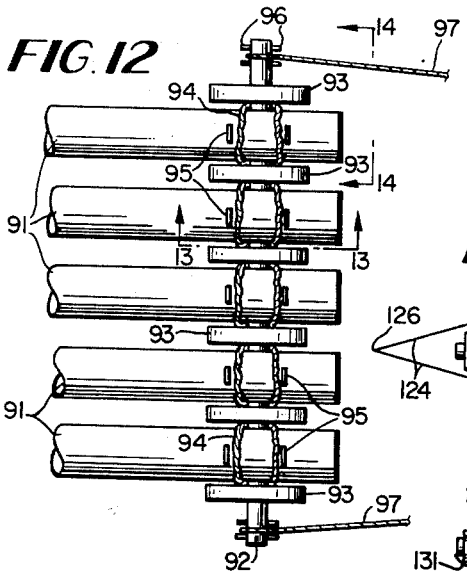
FIG. 12
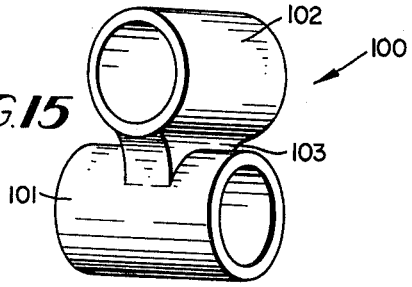
FIG. 15
FIG. 16
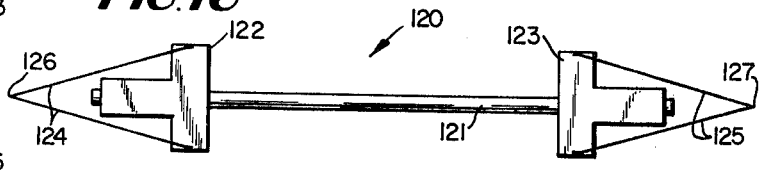
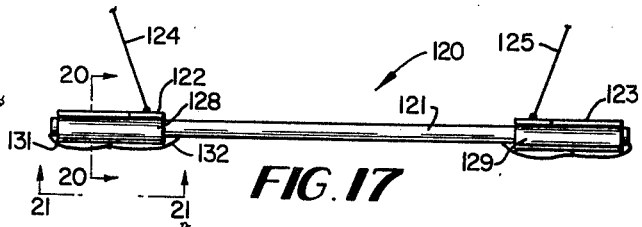
FIG. 17
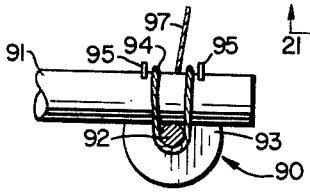
FIG. 13
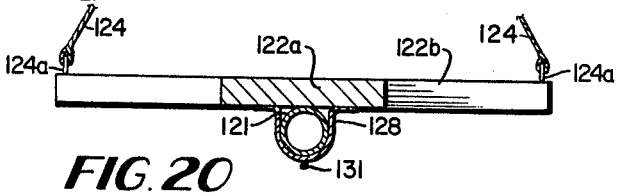
FIG. 20
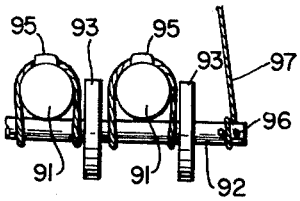
FIG. 14

FIG. 31
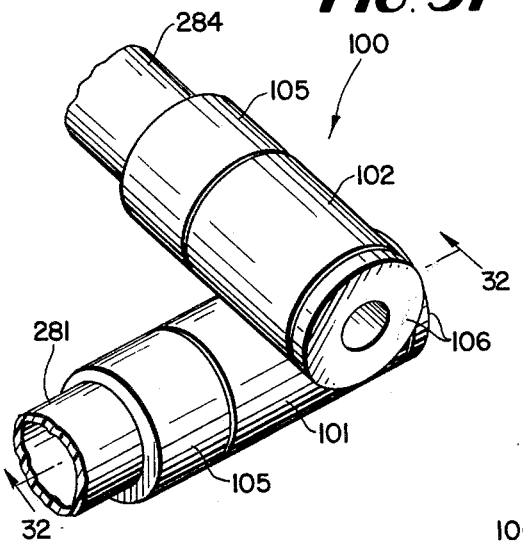
FIG. 32
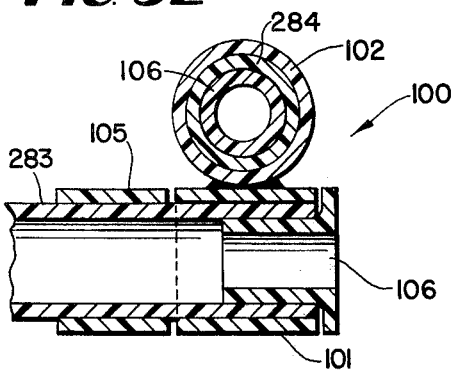
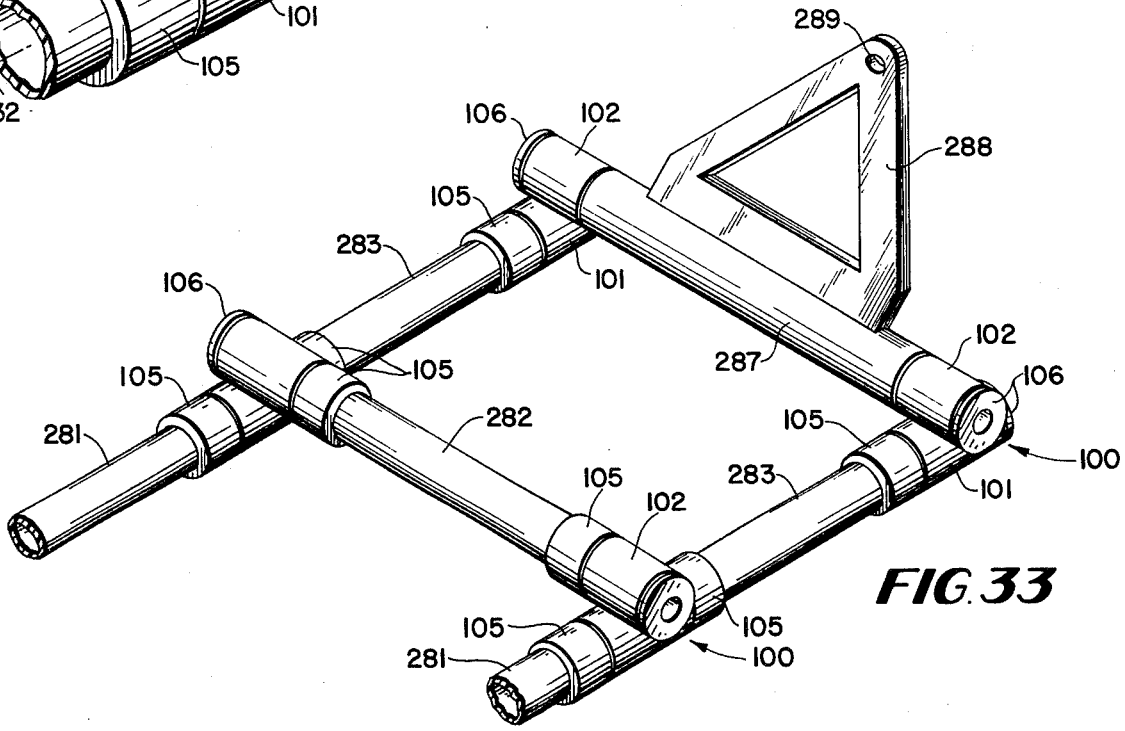
FIG. 33
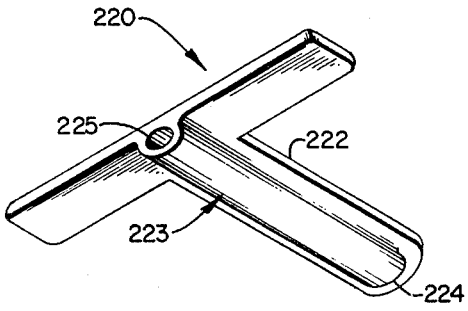
FIG. 34
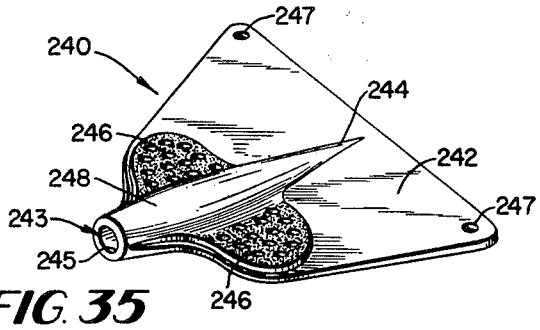
FIG. 35

ROTATABLE SWING

REFERENCE TO RELATED APPLICATION

This application is a continuation-in-part of Ser. No. 160,727, filed July 8, 1971 for "Figure-eight Swing", now U.S. Pat. No. 3,829,086, issued Aug. 13, 1974.

BACKGROUND OF THE INVENTION

1. Field of the Invention

This invention relates to swings having two opposing seats that depend from a support and confront each other. It particularly relates to swings that are interconnected and oscillate to and fro. It especially relates to such swings in which each seat is mounted to be displaced relative to the other seat.

REVIEW OF THE PRIOR ART

Simple swings have been used for uncounted centuries and have been particularly beloved by children. More complicated swings having four suspension lines and two opposing seats, such as the Wallace swing described in U.S. Pat. No. 862,686, have been appreciated by adults for years because of their more sedate operational characteristics.

Swings which are capable of relatively intricate maneuvers are exemplified by the Williams swing which is described in U.S. Pat. No. 2,325,456. This swing comprises a horizontal bar which is suspended at each spaced-apart end thereof by an outwardly inclined chain. The bar is swingable both endwise and sidewise, and a combination of an upward swing and a sidewise twist simulates the movement of a balking horse.

The Zippler swing, disclosed in U.S. Pat. No. 2,146,045, comprises an elongated plank-type swing seat having a looped-steel member and indentations for leg accommodation near each end thereof. A main swinging rod is movably attached to each looped-steel member at its lower eye portion and to a support pivot at its upper end eye portion. A rigid handhold member, disposed horizontally and transversely to both the main swinging rod and to the swing seat, is attached to each main swinging rod within easy reaching distance for the nearby swing rider. By properly manipulating this hand member, any one of the occupants of the swing seat can "impart various motions and movements of the seat, such as horizontal, circular, whirling, gyratory, oval and oscillating."

It is common knowledge that as suburbia covers increasing areas of former farmland, vacant lots, and developers' tracts, children are left with ever-decreasing opportunities for physical exercise, muscle development, and coordination testing. In that sense, and for growing children, suburbia often becomes a desert unless parents provide transportation to a recreational area. Directors of children's playgrounds have also noted the scarcity of available equipment for older children in striking contrast to the abundant, varied devices which are available for younger children. Innercity areas accordingly also lack coordinative exercise opportunities for older children.

A need evidently exists for both backyard facilities and playground equipment that can be simply and inexpensively installed to furnish both younger and older children with exhilarating exercise, seemingly precarious and consequently exciting play, and opportunities for physical coordination. It is also desirable that an older child should learn to cooperate physically with another person, develop a sense of timing, and have opportunities for laughter and group activity.

SUMMARY OF THE INVENTION

The object of this invention is to provide a swing for two persons which is capable of maneuvering along an apparent figure-eight pattern.

Another object is to provide a swing that, when attached to vertically disposed structures in opposed relationship, can be operated in safety therebetween, without contacting the structures.

An additional object is to provide a swing that is usable by three or more persons.

Still another object is to provide a swing having means with which the riders thereof can induce both endwise and sidewise swinging while either sitting or standing.

A further object of this invention is to provide a swing that is capable of such intricate maneuvers, acceleration, and deceleration as to stimulate feelings of adventure and exhilarating excitement in the users thereof.

In satisfaction of these objects and in accordance with the spirit of this invention, a rotatably interconnected two-seater swing having an aligner means and a pair of stabilizer means for preventing upside-down rotation of either end is herein provided. This swing has opposed and rotatably interconnected seats for two persons and is simultaneously swingable endwise, sidewise, and transpositionally from tensional support lines which are fastened to opposed support pivots, whereby the seats are on opposite sides of the vertical plane passing through both of the pivots, while each rider thereof, if sitting or standing perpendicularly to his seat, is approximately bisected by the plane that longitudinally and perpendicularly bisects his seat and passes through the nearer supporting pivot.

In a swing having two opposed and interconnected seats that depend from opposed pivots and confront each other while adapted to oscillate to and fro, this invention is an improvement that comprises interconnecting means that rotatably connect together, space apart, and permit these seats to be mutually displaced transpositionally, whereby the seats are momentarily on opposite sides of the vertical plane passing through both of the pivots, while at all times enabling each of the seats to be disposed perpendicularly to the respective plane that bisects that seat and passes through the nearer of the support pivots.

This rotatable swing comprises, in pairs, a rider means for supporting a rider and a stabilizer means for preventing upside-down revolution of the rider and an interconnecting means for rotatably but non-pivotably connecting the pairs in aligned and spaced-apart relationship. The rotation-permitting interconnecting means comprises an aligner means for aligning the pair of rider-supporting means in spaced-apart relationship, an attachment means for rotatable attachment and connection of the rider-supporting means with the aligner means, and a position means for rotatably maintaining the spaced-apart relationship. Each attachment means, position means, and stabilizer means form a rider assembly. The aligner means also provides means for additional users of the swing to participate, as a spontaneous group activity, in maneuvers by the riders thereof. Some embodiments further comprise means for inducing endwise and sidewise swinging motions.

The stabilizer means enables the center of gravity of a rider to remain below or inside of at least one fastening position for a tensional support means so that the rider and his supporting structure do not revolve into an upside-down position even when momentarily in a steeply inclined relationship to the ground. The stabilizer means can be in the form of a spreader means or a hanger means, for example.

A spreader means spreads apart sidewise a pair of fastening positions for a bifurcated tensional support means; the pair of fastening positions is preferably located at the seating level and must be disposed substantially perpendicularly to the aligner means. A hanger means provides a longitudinally pivotal connection to the rider assembly, a rigid hanger member extending upwardly at least to the center of gravity of the nearby rider and preferably somewhat thereabove, and a fastening position at its upper end for a single tensional support means.

The aligner means maintains both rider assemblies in alignment at all times and, in cooperation with a position means, spaces these rider assemblies apart by a selected distance. The rider assemblies generally comprise rider-supporting structures, such as a pair of seats, in opposed relationship, these structures being interconnected by the aligner means in cooperation with the position means and an attachment means.

Each attachment means provides rotatable but non-foldable attachment of each rider assembly to the aligner means and, if the aligner means is outside of the longitudinal center line of the swing, alternatively or additionally provides pivotable attachment as well while preventing folding movement of the aligner means and the rider structure.

Each rider assembly therefore comprises a stabilizer means, an attachment means, a position means, and a rider means, but the rider means need not be a distinct structure; for example, the spreader means or the attachment means may function as a rider-supporting structure. Selectively, a seesaw means for inducing endwise swinging may also be combined with the rotatable swing or may be an integral part of each rider assembly.

The tensional support means is preferably a chain but may be a cable, rope, or other type of line having adequate tensile strength and abrasion resistance and is hereinafter referred to as a rope. The tensional support means for each spreader means is a pair of support lines which diverge downwardly from a single support pivot, attached to a supporting structure, to the pair of fastening positions. The tensional support means for each hanger means is a single support line attached at its upper end to a single support pivot and at its lower end to the fastening position at the upper end of the hanger member.

The aligner means is preferably a shaft or pole or a plurality thereof, but it may be any relatively rigid shaft, having adequate strength and a selected stiffness, that is disposed horizontally when the swing is quiescent and, when in combination with a spreader means, is disposed at all times transversely to imaginary lines connecting the fastening positions, hereinafter termed the rope ties, for each pair of ropes. The aligner means is hereinafter termed an aligner shaft or a plurality thereof.

An aligner shaft may be wholly or partially solid, hollow, or in sections. If hollow, a coaxially disposed cable, which is attached at its ends to each rider assembly and stretched tautly therebetween, functions effectively as a position means and cooperatively as a part of the attachment means.

"Endwise" refers to the direction in parallel to the aligner shaft, and "sidewise" refers to the direction transverse to the aligner shaft. "Inward" denotes the endwise direction toward the longitudinal midpoint of the aligner shaft, and "outward" refers to the endwise direction away therefrom and toward either end, inward and outward being applicable for directions at positions outside of the swing.

The spreader means has adequate width, in transverse disposition to the aligner or shafts, to separate or spread apart the pair of ropes attached at the rope ties sufficiently that the spreader means remains at all times perpendicularly disposed to the imaginary plane which longitudinally and perpendicularly bisects the spreader means and passes through the nearer support pivot.

The spreader means and the rider means may be combined as an endwise-narrow-but-sidewise-elongated flat bar or round bar, both herein defined as a spreader bar, capable of supporting a rider and having a sidewise rope-spreading function but no apparent seating function, or may be combined as a generously proportioned seat, herein defined as a spreader seat, having both apparent functions because of adequate endwise depth for seating. Alternatively, the rider means may be supplementary to the spreader means as an auxiliary seat, evidently having a seating function only.

The rope ties, as fastening positions for the ropes in various embodiments, comprise metal eyes, holes in a spreader bar or spreader seat, retention pins surrounding a rope wrapping section of an aligner shaft or a spreader bar, or nothing at all but a part of the aligner shaft or a spreader bar where the structural arrangement prevents slipping therealong. Although metal eyes are desirable for use with chains as the preferred tensional support means, fairly thick manila rope, such as one-inch and thicker, has been satisfactory, particularly for wrapping and tieing around a bare cylindrical member.

The attachment means generally surrounds the aligner shaft while permitting rotatable movement thereof and preventing folding movement with respect to the spreader means. The attachment means is preferably a strap or a plurality of lined-up straps which partially surround the shaft and are attached at the ends thereof to the spreader seat thereabove or, alternatively, a collar which is in annular relationship to the aligner shaft and is attached, as by welding, to the spreader seat or the spreader bar. The attachment means may also be a pair of elongated members whcih are parallel to the aligner shaft and in straddling relationship therewith while cooperating with a bar, a spreader seat, or an auxiliary seat to control movements of the shaft. The attachment means may also comprise a pair of disc-shaped members which co-operate with an aligner-shaft enwrapping cable, wherely pivoting movement of the shaft is additionally feasible.

The position means maintains the aligner shaft and each rider assembly in the selected spaced-apart relationship while permitting the desired relative movements therebetween. For use with a strap or a collar as the attachment means, a pair of flanges, straddling the collar and attached to the shaft, is preferred. For any attachment means, a cable, which is fastened to a part of each rider assembly and to the aligner shaft on either side thereof, is satisfactory. If sufficiently slack to provide for a 45° rolling movement, the cable may run longitudinally of the aligner shaft. A pair of cables which are fastened to a part of the rider assembly and pass in inward and outward directions through a pair of opposed pulleys, attached to the shaft, are preferred. For use with shaft enwrapping cables as a part of the attachment means, retention ridges or loops may be attached to the aligner shaft in straddling relationship to the cable.

Both multishaft and monoshaft embodiments of the rotatable swing are provided herein. In general, in order that a swing of this invention may be capable of executing apparent figure-eight movements, the aligner shaft must be rotatably connected to each rider assembly and, of course, must be restrained from folding and longitudinal movements relative thereto. If the shaft is centrally disposed to the rider assembly, such rotating movement is sufficient and is all that is provided in a monoshaft swing.

However, if the shaft is not disposed centrally to the rider assembly, the attachment means must also provide for pivotable movement in addition to rotatable movement therebetween. Rotatable movement is herein defined as rotating of the aligner shaft about its own axis and generally no more than ± 45°. Pivotable movement is herein defined as pivoting of the aligner shaft about the spreader seat or spreader bar, as the approximate transverse axis of the movement, in an up-and-down direction as measured when the swing is quiescent. Folding movement, which must be substantially prevented, is herein defined as pivoting of the aligner shaft toward parallel disposition with the pair of rope ties of either rider assembly or with a spreader bar, for example.

As means for inducing endwise swinging motions, a seesaw means is provided in combination with the rotatable swing of this invention. This seesaw means may be in either or both of two forms: 1.) an endwise extension of the rider means outwardly of the rope ties, or 2.) an auxiliary assembly of ropes and handbars. If the ropes are inclined outward the support pivots, an up-and-down or seesaw motion is created by the endwise motion.

BRIEF DESCRIPTION OF THE DRAWINGS

FIG. 7 is a side perspective view from above of a duoshaft embodiment, having a seesaw extension on each end and outwardly inclined support lines, that shows threaded position means and attachment means, in combination.

FIG. 8 is a detailed cross section of the threaded tee serving as the position and attachment means that connects a shaft and a spreader bar, looking in the direction of the arrows 8—8 in FIG. 7.

FIG. 9 is a perspective view of one corner of the duoshaft swing of FIG. 7, with a seat attached pivotably to the spreader bar and resting pivotably on the seesaw bar.

FIG. 10 is a sectional elevation view that shows the seat in side view, looking in the direction of the arrows 10—10 in FIG. 9.

FIG. 11 is an end elevation view of the seat shown in FIGS. 9 and 10, looking in the direction of the arrows 11—11 in FIG. 10.

FIG. 12 is a top view of one end of a multishaft swing in which the aligner shafts and the spreader bar are attached pivotably and rotatably by means of a cable-wrap attachment means.

FIG. 13 is a sectional elevation view of the multishaft swing shown in FIG. 12, looking in the direction of the arrows 13—13 in FIG. 12.

FIG. 14 is an end elevation view of one corner of the multishaft swing of FIG. 12, looking in the direction of the arrows 14—14 in FIG. 13.

FIG. 15 is a perspective view of a double-collar joint as an attachment means for a spreader bar and an aligner shaft crossing each other in over-and-under relationship.

FIG. 16 is a top view of a monoshaft embodiment of the rotatable swing of this invention, having outwardly disposed support lines and tee seats functioning as the rider means, which is shown in quiescent position.

FIG. 17 is a side elevation view of the rotatable swing shown in FIG. 16.

FIG. 20 is a detailed sectional elevation view of the rider assembly of the swing shown in FIGS. 16, 17, 18, and 19, looking in the direction of the arrows 20—20 in FIG. 17.

FIG. 31 is a perspective view of the double-collar joint of FIG. 15 as the attachment means for pipe members crossing each other in over-and-under relationship, as at the corner of a duoshaft swing, with a collar and a flanged insert, in combination, as a position means on each pipe.

FIG. 32 is a sectional view of the double-collar joint and pipe members of FIG. 31, looking in the direction of the arrows 32-32 in FIG. 31.

FIG. 33 is a perspective view of one end of a duoshaft swing, similar to the swing of FIG. 7, which is constructed of pipe members which are attached with the double-collar joint of FIGS. 15 and 31 and positioned with the collar-insert combination of FIG. 31 where they cross each other in over-and-under relationship, the stabilizer means being a triangular hanger means which is rotatably attached to the outer spreader bar so that there is no seesaw means and movement of the hanger bar is pivotable, i.e., its arcuate movement is aligned with the aligner shaft.

FIG. 34 is a bottom perspective view of a rider assembly comprising a shaft tunnel with closed outer end which is integrally molded with the spreader seat thereabove, a part of the position means being omitted.

FIG. 35 is a top perspective view of a rider assembly comprising a spreader seat into which a shaft is centrally molded, forming a crotch ridge, a part of the position means being omitted.

Figure 1:
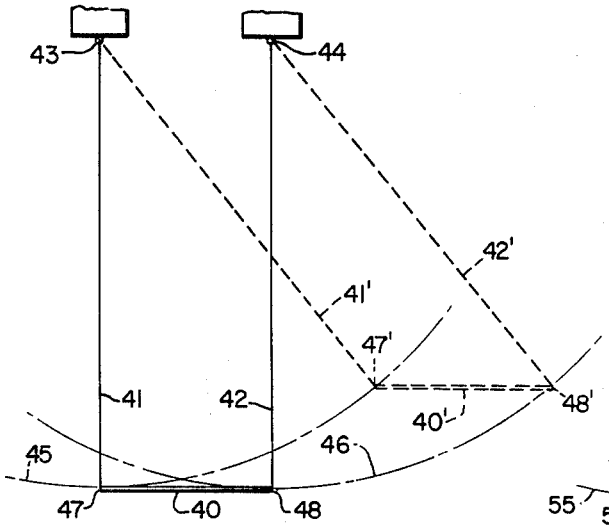
FIG. 1 is a side elevation view of a swing, having vertically disposed support lines, which remains horizontal when swinging endwise, as shown in phantom, for illustrating level endwise swinging movement for any swing of the prior art and of this invention when thus supported.

In the drawings, numerous embodiments of the aligner means, stabilizer means, attachment means, and position means are shown. Multishaft embodiments of the aligner means are in FIGS. 4–9, 12–14, and 33. Monoshaft embodiments of the aligner means are in FIGS. 16–30 and 36–42. Sectional-shaft embodiments are in FIGS. 36–38.

Figure 41:
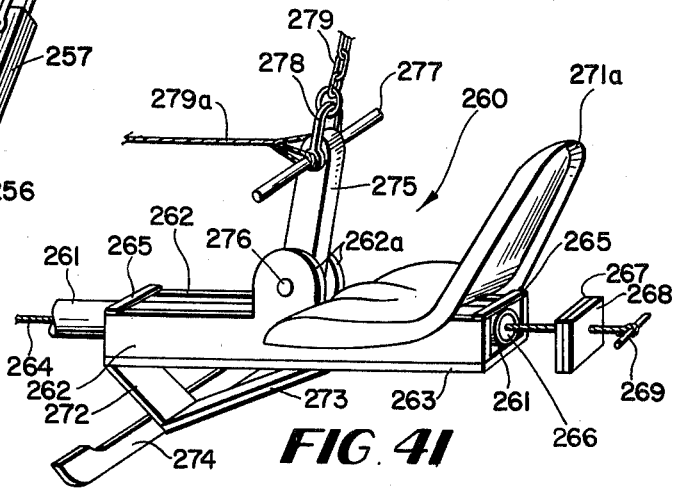
FIG. 41 is a perspective view of a rider assembly comprising an integrally molded seat with backrest, an alignment box having a pivot bracket, a hanger bar, a footrest, and a coaxially disposed cable.

The spreader means form of the stabilizer means is shown in FIGS. 4–9, 12–14, 25–30, and 38, as spreader-bar embodiments, and in FIGS. 16–24, 34, and 35 as spreader-seat embodiments. The hanger means form of the stabilizer means is shown in FIGS. 33, 39, and 41.

Figure 6:
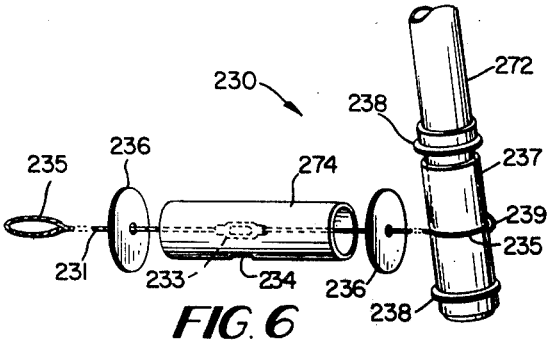
FIG. 6 is an exploded perspective view of a cable-loop attachment means that rotatably and pivotably connects a spreader bar and an aligner shaft.
Figure 21:
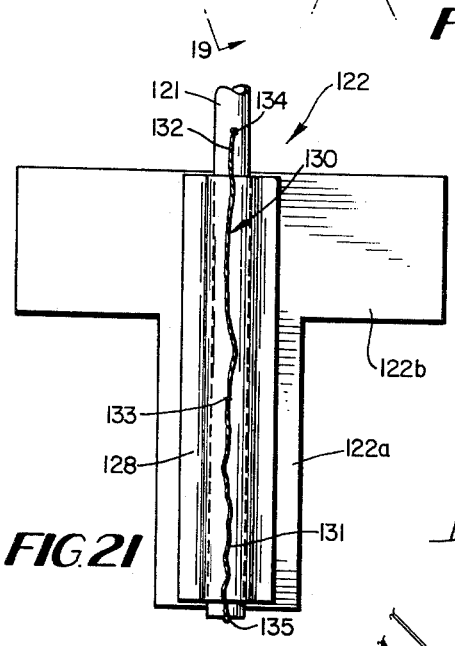
FIG. 21 is a bottom view of the rider assembly shown in FIGS. 16, 17, 18, 19, and 20, looking in the direction of the arrows 21—21 in FIG. 17.
Figure 23:
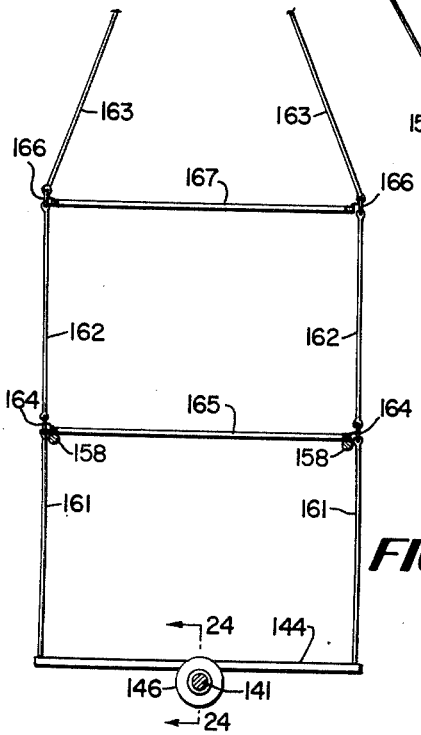
FIG. 23 is a vertical sectional view of the swing shown in FIG. 22, looking in the direction of the arrows 23—23 in FIG. 22.
Figure 22:
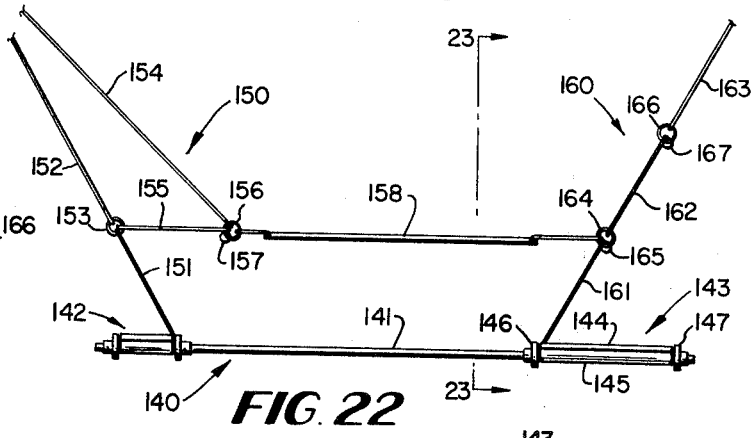
FIG. 22 is a side view of another monoshaft embodiment of the rotatable swing of this invention, having an inward endwise swing means, an in-line endwise swing means, and sidewise swing means.
Figure 24:
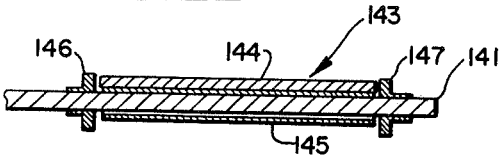
FIG. 24 is a detailed sectional view of the rider assembly at the right-hand side of the swing shown in FIG. 22, looking in the direction of the arrows 24—24 in FIG. 23.
Figure 30:
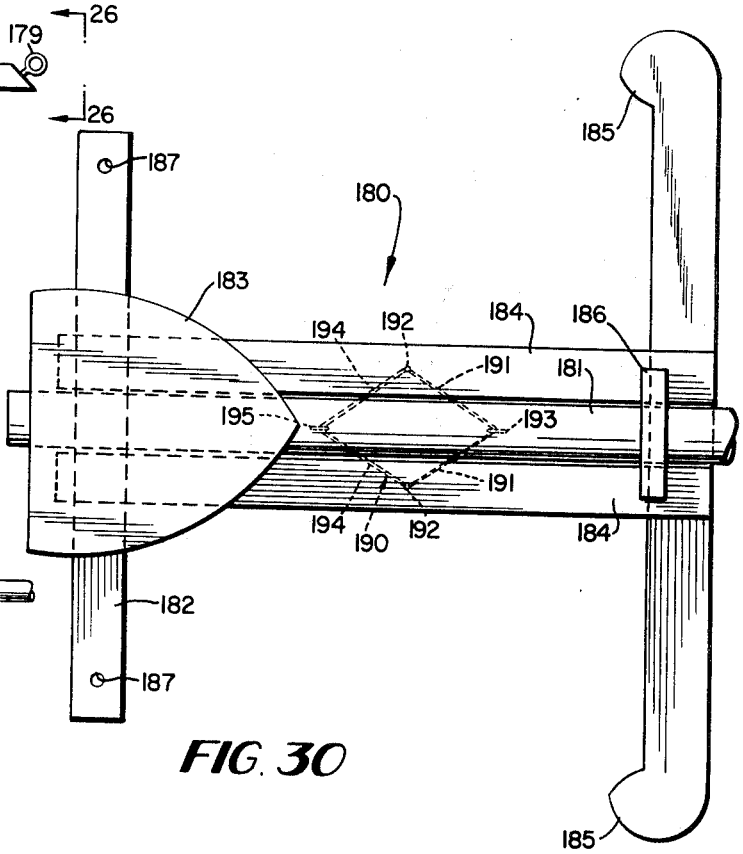
FIG. 30 is a top view of the embodiment shown in FIGS. 28 and 29 that clearly shows the inwardly disposed footrest.
Figure 28:
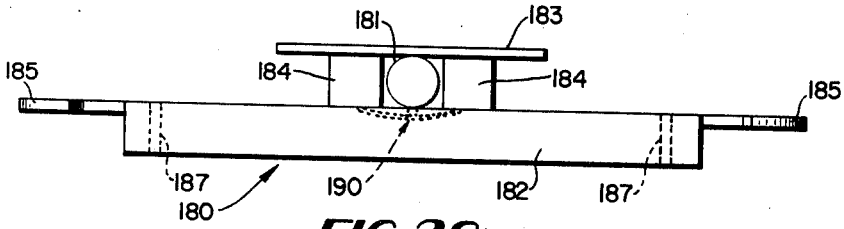
FIG. 28 is an end view of another embodiment of a rider assembly having a spreader bar beneath the aligner shaft and a seat thereabove, both of which cooperate with a pair of alignment members to form the attachment means. A pair of cables passing over opposed pulleys forms the position means.
Figure 29:
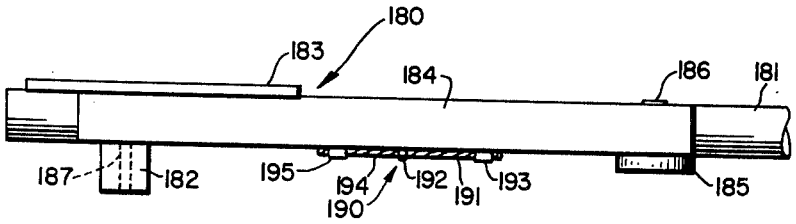
FIG. 29 is a side elevational view of the embodiment shown in FIG. 28.
Figure 38:
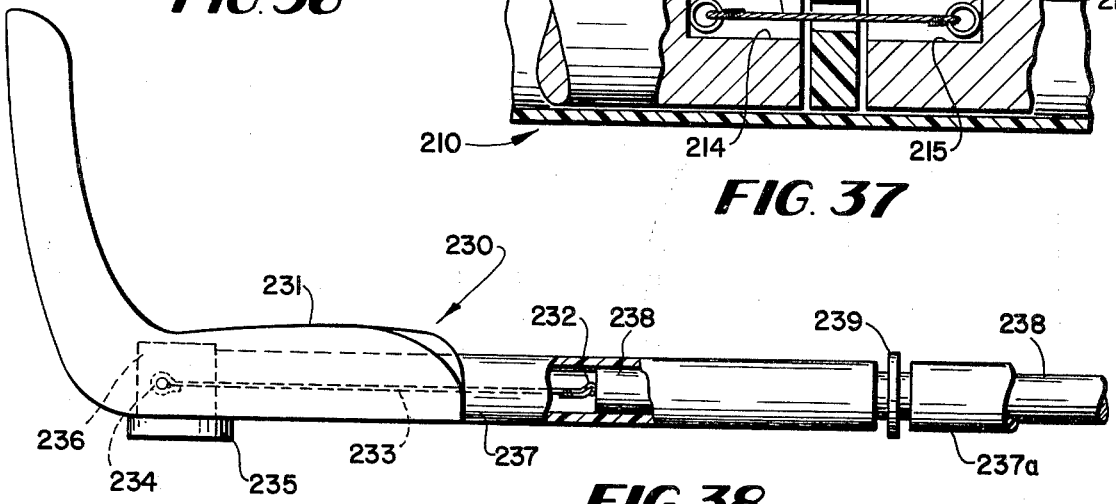
FIG. 38 is a side view of a rider assembly comprising an integrally molded seat and backrest, a spreader bar, an elongated collar which is rigidly attached to the seat, a solid central shaft, and a terminal cable functioning as a position means.
Figure 39:
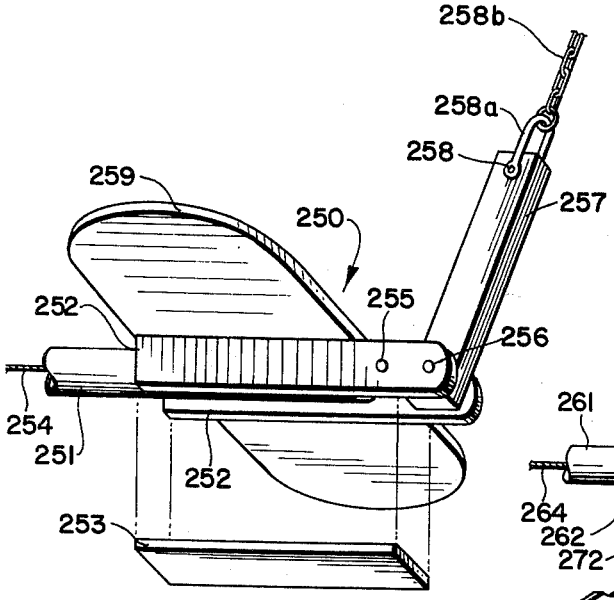
FIG. 39 is a bottom perspective view of a rider assembly comprising a hanger bar, a pair of alignment members to which it is pivotably attached, a seat thereabove, a bottom member, and a hollow shaft which is abutted against a transverse rod to which a coaxially disposed cable is attached.

Various embodiments of the attachment means are in FIGS. 15 and 31–33 as the double-collar joint 100, in FIG. 6 as the cable-loop attachment means 230, in FIGS. 7-9 as the threaded tees 85, in FIGS. 12–14 as the disc-cable wrap 90, in FIGS. 17, 20, and 21 as the strap 128, in FIGS. 22–24 as the collars 145 and 173, in FIGS. 28–30 as the alignment members 184 (combined with seat 183 and spreader bar 182), in FIGS. 34 and 35 as the shaft tunnels 223 and 243, in FIG. 38 as the shaft collar 237, and in FIGS. 39–42 as the alignment boxes 252, 253, 262, 263, 268.

Figure 25:
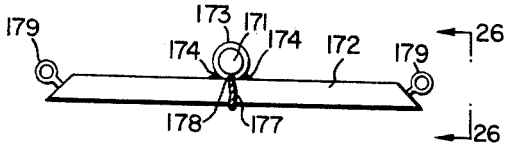
FIG. 25 is an end view of another embodiment of a rider assembly and of the aligner shaft of a monoshaft swing in which a spreader bar is beneath the aligner shaft.
Figure 27:
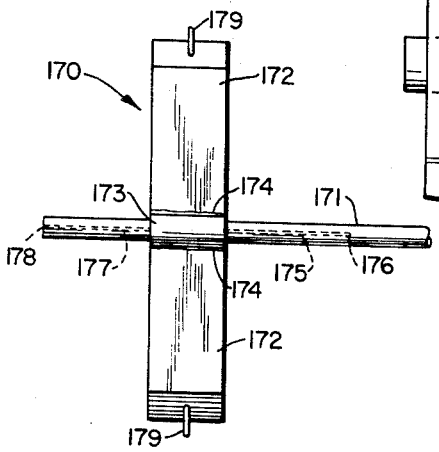
FIG. 27 is a top view of the embodiment shown in FIGS. 25 and 26.
Figure 26:
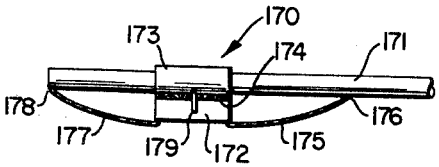
FIG. 26 is a side elevational view of the embodiment shown in FIG. 25.

Various embodiments of the position means are in FIGS. 6, 22–24, 31, and 32 as the retention flanges 238, the flanges 146, 147, and rings 105, respectively, in FIGS. 12–14 as the cableretention ridges 95, in FIGS. 17, 20, and 21 as the restraint cables 131, 132 with screws 133, 134, 135, in FIGS. 28-30 as the pulley positioning means 190, in FIG. 25-27 as the separate cables 175, 177 with screws 176, 178, and in FIGS. 36–42 as the coaxial cables 203, 213, 233, 254, 264, associated with washers 207 and bars 255, 269.

Over-and-under relationship of shafts and spreader bars is shown in FIGS. 12–14, 25–33, and 38. Same-plane relationship of shafts and spreader bars is shown in FIGS. 4-9. Separate or auxiliary seats, as the role rider means, are shown in FIGS. 9–11, 28–30, 38, 39, and 41. Spreader seats are shown in FIGS. 16–24, 34, and 35. Seesaw means are shown in FIGS. 7,9, and 16–24, but the handbar assemblies 150, 160 are not properly an integral part of a rotatable swing.

Any aligner means, stabilizer means, attachment means, position means, rider means, and seesaw means may be combined to form a wide variety of rotatable swings as dimensions and strength requirements permit.

A preferred embodiment of any one means for combining with suitable embodiments of the other means to form a specific rotatable swing, such as one of the swings shown in the drawings, may not, however, be similarly preferred for constructing another specific swing.

DESCRIPTION OF THE MULTISHAFT SWINGS

The rotatable swing of this invention may be monoshaft, multishaft, or sectional-shaft as to its aligner means, and any selected shaft or shafts may be combined with a spreader means or a hanger means as its stabilizer means.

If an odd number of shafts are used in a multishaft embodiment, the center shaft has the attributes and functional characteristics of a monoshaft embodiment as described hereinafter. The most suitable multishaft embodiment is the duoshaft swing whose shafts can be spread far enough apart for use as swinging exercise poles, particularly during simple sidewise swinging, while being accessible to a number of users in group play.

Endwise swinging produces a variety of motions, especially if the support lines are outwardly inclined, and is particularly productive of unexpected movements and forces if combined with sidewise swinging to produce what is, or appears to the observer to be, figure-eight swinging, wherein the ends of the swing move independently into transposed positions and over semicircular and spiral paths while the entire swing is being translated in both endwise and sidewise movements.

Figure 2:
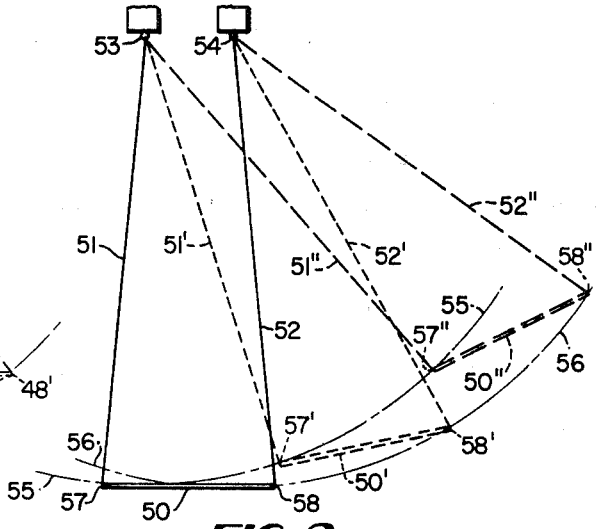
FIG. 2 is a side elevation view of a swing, having inwardly disposed support lines, which tilts rearwardly when swinging endwise, as shown twice in phantom, whereby the trailing end of the swing becomes lower than the leading end thereof, for illustrating curvilinear endwise swinging movemement for any swing of the prior art and of this invention when thus supported.
Figure 3:
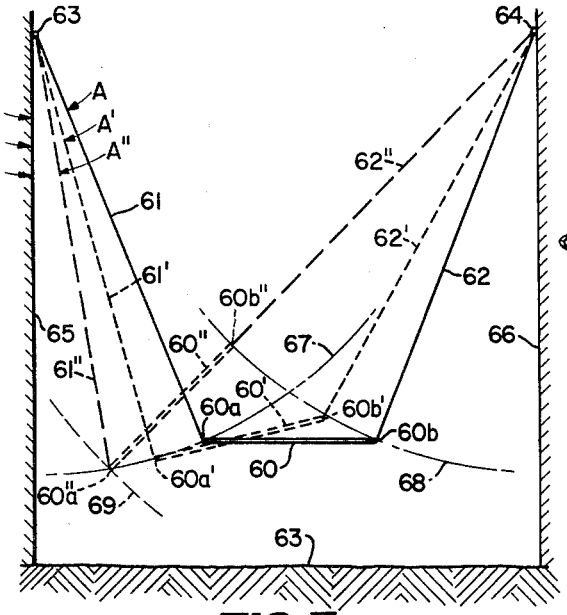
FIG. 3 is a side elevation view of a swing, having outwardly disposed or inclined support lines between vertically disposed support structures, which tilts forwardly when swinging endwise, whereby the trailing end of the swing becomes higher than the leading end thereof, as shown twice in phantom, for illustrating seesaw endwise swinging movement for any swing of the prior art and of this invention when thus supported.

Endwise swinging is analyzed in FIGS. 1, 2, and 3 for the swings 40, 50, and 60, respectively. FIGS. 1, 2, and 3 are shown for illustrative purposes only in order to demonstrate the effects that are created by various inclinations of the ropes upon endwise swinging in a vertical plane. The swings 40, 50, 60 are not embodiments in themselves but represent any two-seater swing known to the prior art and also correpond to FIG. 4 and every other embodiment of this invention.

The swing 40 has vertically disposed tensional support lines 41, 42 which are attached to pivot-permitting support positions 43, 44. These are spaced apart by the same distance as the length of the swing 40. Endwise swinging, as shown in phantom, causes the swing 40' to remain horizontal and the lines 41', 42' to remain mutually parallel, so that the trailing end 47' remains level with the leading end 48' as they move through the arcs 45, 46.

The swing 50, however, is suspended from inwardly disposed or inclined tensional support lines 51, 52 which are attached to the pivot-permitting supports 53, 54. These supports are spaced apart at a lesser distance than the length of the swing 50. When endwise swinging occurs, the trailing ends 57', 57'' of the phantom swings 50', 50'' are lower than the leading ends 58', 58'' in a natural-feeling simulation of the arcs 55, 56.

The swing 60 is suspended from outwardly disposed or inclined tensional support lines 61, 62 which are attached to pivot-permitting supports 63, 64 on vertically disposed building walls 65, 66. These supports 63, 64 are spaced apart by a greater distance than the length of the swing 60 between the leading and trailing ends 60*a*, 60*b*, respectively.

When endwise swinging occurs, the trailing ends 60*b'*, 60*b''* become progressively higher than the leading ends 60*a'*, 60*a''*. This lifting effect and the succeeding sinking effect cause children to term an endwise movable swing, when mounted with outwardly inclined support lines, a "swinging seesaw". If two riders of the swing 60 differ considerably in weight, the lighter person is quite apt to rise to the limit represented by 60*b''*.

When installing an endwise movable swing between two vertically disposed structures, such as the walls 65, 66 in FIG. 3, the length of the aligner shaft or shafts is measured by stretching and aligning the line 62'' with the swing 60'' while maintaining the line 61'' downwardly taut so that the leading end 60*a''* describes the arc 69. The intersection of the arcs 67, 69, at the downwardly dipping end 60*a''*, must not be dangerously close to any supporting structure 65 or 66, to the ground 63, or to any other obstructions, so that the aligner shaft or shafts of the swing 60 must be cut accordingly or the length of the lines 61, 62 must be adjusted.

The length of the aligner means should not, however, be any shorter than necessary because the available endwise swinging distance is thereby shortened. Obviously, if the aligner shaft were shortened to the vanishing point so that the ropes 61, 62 met at common fastening positions, the swing would operate like a true seesaw but would have no freedom to swing endwise. The quiescent angle A must, therefore, be such that the minimum angle A'' is always as little above zero as is practicable.

Figure 5:
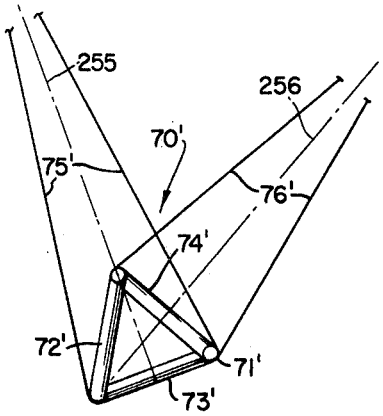
FIG. 5 is an end view of the duoshaft embodiment of FIG. 4 in its transposed position, looking in the direction of the arrows 5—5 in FIG. 4.
Figure 4:
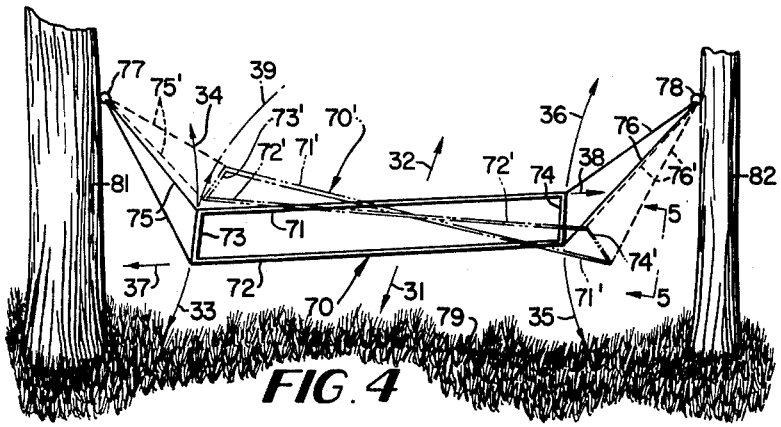
FIG. 4 is a side perspective view from above that shows a duoshaft embodiment of the swing of this invention, having outwardly inclined support lines attached to the trunks of trees, which is swinging sidewise away from the observer and is, in phantom, in a transposed position.

A simple duoshaft swing is shown in FIGS. 4 and 5. This swing comprises two longitudinal members, which are the aligner means, and two transverse members, which are the spreader means for stabilizing each end. The longitudinal members are the shafts 71, 72 and the transverse members are the spreader bars 73, 74 of the swing 70 in FIGS. 4 and 5 which are connected, by attachment means not shown, so as to permit the shafts 71, 72 to rotate and simultaneously pivot with respect to the spreader bars 73, 74, as shown in phantom in FIG. 4 and in FIG. 5.

The entire swing 70, suspended at each corner from the two pairs of upwardly converging and outwardly disposed ropes 75, 76 which are attached to the support pivots 77, 78, respectively, on substantially vertical tree trunks 81, 82, is free to swing sidewise in directions 31, 32 and to swing endwise in directions 37, 38. Each end of the swing 70 is further free to move circularly beneath its respective support pivot, i. e., the nearer of the two support pivots 77, 78, along the arcuate paths 33, 34 and 35, 36, but as one end moves along such an arcuate path, the other end must move upwardly and toward the other pivot in a spiral path.

For example, the end comprising the spreader bar 73 must move along the spiral path 39 if the swing moves transpositionally, as indicated by the swing 70'. However, the end comprising the spreader bar 73 moves along a more gentle spiral if both ends of the swing 70 stay on the same side of the vertical plane passing through the support pivots 77, 78 while the end moves circularly beneath its support pivot, such as along the arcuate path 36. The bottom of the spreader bar 74' is visible at the right-hand end of the phantom swing 70' which is transposed, each spreader bar 73', 74' being bisected by the longitudinally disposed planes 255, 256, respectively, that pass through the respective pivots 77, 78.

The support pivots must be sufficiently far above the ground 79, with respect to the length of the ropes 75, 76, and the shafts 71, 72 should have such length that the tree trunks 81, 82 and the ground 79 are never contacted by the swing 70 while the quiescent angle between the support ropes 75, 76 and the tree trunks 81, 82 is minimal.

A suitable attachment means is shown in FIG. 6 for use with the swing 70 if the spreader bars 73, 74 are hollow cylinders (such as a pipe, preferably of fiberglass-polyester or the like reinforced plastic material) in the same plane as the aligner shafts when the swing is quiescent. This cable-loop attachment means 230 comprises a disc 236, centrally disposed at each end of each spreader bar 274, that has a central hole therein through which a cable 231 passes. Each terminus of the cable 231 is a loop 235. A collar 237, having a slighly larger inside diameter than the outside diameter of the shaft 272, is caught within each loop 235. A pair of retention flanges 238 are rigidly attached to the shaft 272 after it has been inserted into the collar 237. A collar hoop 239 is attached to the collar 237 as part of the position means to keep the loop 235 from slipping longitudinally thereof. A turnbuckle 233 in the middle of the cable 231 within the spreader bar 274 enables the cable 231 to be tightened sufficiently to keep the shaft 272 firmly against the disc 236 without impeding the freedom of the shaft 272 to rotate and pivot as the swing moves transpositionally as exemplified by the swing 70' in FIGS. 4 and 5. An opening 234 is provided in the bottom of the spreader bar 274, of sufficient size to admit a tool for adjusting the turnbuckle 233 when necessary.

A more complex duoshaft swing 80 is shown in FIG. 7. This swing 80 comprises two longitudinally disposed aligner shafts 81, two transversely disposed spreader bars 82, four attachment tees 85, and two seesaw ends, each comprising two seesaw shafts 83, one seesaw bar 84, and two attachment elbows 86, the aligner shafts, seesaw shafts, spreader bars, and seesaw bars being in the same plane when the swing is quiescent. Each member of two pairs of ropes 87 is attached to a shaft 81 by a wrapping 87*a* therearound. If the pairs of ropes 87 are outwardly disposed, the wrappings 87*a* must be inwardly of the tees 85, as shown in FIG. 7. If the pairs of ropes 87 are inwardly disposed or inclined, it is obviously preferable to locate the wrappings 87*a* outwardly of the tees 85.

The tees and elbows 85, 86 are threaded, as may be seen in FIG. 8. The joints between shafts 81, 83 and bars 82, 84 are made barely finger tight and then backed off by three-fourths of a turn. Pivoting movements 88 and rotating movements 89 are consequently performed by means of the threads 82*a,* 85*a* for the tees 85 and attached spreader bar 82, and by means of corresponding threads, not shown in the drawings, for other shaft-bar joints. Abrasion of the threads 82*a,* 85*a* is preferably minimized by use of friction-minimizing coatings thereon, such as grease or a polymeric low-friction material of the type sold under the trademark "Teflon" by I. E. duPont de Nemours & Co.

A seat means 110 for the duoshaft swing 80 is shown in FIGS. 9, 10, and 11, for the right-hand side thereof only, as illustrated in FIG. 7. The seat means 110 is pivotably attached to the spreader bar 82 by the wrap-around hook 112 and rests pivotably upon the seesaw bar 84 by means of the prism 113, whereby the seat 111 is perpendicular at all times to an imaginary plane drawn through the nearer supporting pivot and bisecting the downwardly diverging pair of support ropes 87 attached thereto even though the seesaw bar 84 moves to other angular relationships that reflect the transposed position of the spreader bar 82 and seesaw bar 84 at the left side of the swing 80 in FIG. 7.

A side view of this seat means 110 is available in FIG. 10, and an end view is visible in FIG. 11. Pivoting capabilities of the seat 111 relative to the seesaw bar 84 are apparent from this end view and can be increased by increasing the height of the prism 113 or by narrowing the width of the seat 111 over the seesaw bar 84.

A true multishaft embodiment is shown in FIGS. 12, 13, and 14. The pentashaft swing, shown therein as a fragment, comprises five aligner shafts 91, a spreader bar 92 at each end thereof, and, as an attachment and positioning means, the disc-cable wrap 90 that comprises a pair of spreader discs 93 which straddle each shaft 91 and are flatly adjacent thereto, an enless cable wrap 94 which circumwraps each shaft 91 between each pair of spreader discs 93 and the section of the spreader bar 92 passing therebeneath, and a pair of cable-retention ridges 95 which straddle each cable wrap 94 atop each shaft 91. At its simplest form, such a cable retention ridge 95 could be a metal staple driven partially into a wooden shaft 91 so that the parallel side members of the staple straddle a cable 94 passing over the shaft 91. It is important, however, that the endless cable wrap 94 be loosely fitting, not tightly so, as is the cable-loop attachment means 230.

On end of the pentashaft swing is visible as a top view in FIG. 12, and one corner is visible as a sectional side elevation in FIG. 13 and as an end elevation in FIG. 14. A pair of ropes 97 is wrapped around the spread-apart ends of the spreader bar 92, each wrapped fastening, a rope tie, being held in place by a pair of pins 96 in straddling relationship thereto.

Another attachment means, for connecting a cylindrical spreader bar and a cylindrical aligner shaft in a multishaft swing, is shown in FIG. 15. If used on a monoshaft swing, the spreader bar would not have to be cylindrical, and the spreader bar collar 102 could be correspondingly shaped, for relative pivoting movement would not be needed.

The double-collar joint 100 is an efficient attachment means which comprises a shaft collar 101, a spreader bar collar 102, and a rigid collar joint 103. It is suitably cast or molded an an integral piece, preferably from fiberglass-reinforced plastics of considerable strength, such as epoxy.

This attachment means 100 is useful as a joint of a multishaft swing; for example, as replacements for the tee 85 and elbow 86 in the swing 80 if the bars and shafts cross in over-and-under relationship. Such a swing is shown in part in FIGS. 31–33 wherein a duoshaft swing 280 is attached with double-collar joints 100 which are positioned with a collar 105 and flanged insert 106 in straddling relationship to each, the collar 105 being used for a protruding member and the insert 106 for an end thereof.

This duoshaft swing 280 is stabilized with a hanger means comprising the pivot tube 287, which completely surrounds the seesaw bar 284 so that a collar 105 is not needed adjacent the corner joints 100, and the triangular hanger bar 288, having a rope tie 289 which is above the center of gravity of the rider. Movement of this hanger bar 288 is pivotable in that its arcuate movement is parallel to the aligner shafts 283, whereby the swing 280 remains substantially, although not as precisely as with a spreader means, disposed perpendicularly to the plane that bisects the seesaw bar 284 and passes the nearby support pivot.

The fit of the shaft collar 101 and spreader bar collar 102 must be loose so that free rotation in two mutually perpendicular planes is readily available. With a retention means on the shafts and bars, such as the pair of straddling flanges 238 in FIG. 6 or the collar 105 and insert 106 in FIG. 31, longitudinal movement of both spreader bar and aligner shaft can be prevented. Two pairs of such straddling flanges, collars, or inserts are thus an effective position means, enabling the double-collar joint 100 to be useful in any rotatable swing, multishaft or monoshaft, having over-and-under crossing of spreader bars and aligner shafts.

DESCRIPTION OF THE MONOSHAFT SWINGS

The monoshaft embodiments of the rotatable swing comprise a pair of rider assemblies, a single, centrally disposed aligner shaft that aligns and spaces apart the rider assemblies, an attachment means permitting rotational movement therebetween, and a position means that maintains the selected spacing. A pair of support lines are fastened to opposite sides of each spreader means and converge upwardly to a supporting pivot which may be attached to a tree trunk, tree limb, unused telephone pole, building wall, or other vertically disposed supporting structure, or to a tree branch, basement ceiling, or other longitudinally disposed supporting structure, as a bifurcated tensional support means. A single support line is fastened to each hanger means and extends upwardly to the corresponding pivot.

The pivots may be spaced more closely than, the same distance as, or less than the length of the monoshaft swing, as measured longitudinally between fastening positions for the support lines. Both endwise and sidewise swinging movements can be executed, and the ends can follow circular paths as well as spiral paths in executing what appear to be figure-eight patterns.

One monoshaft embodiment, the seat-strap swing 120, is shown in FIGS. 16, 17, 18, 19, 20, and 21. The seat-strap swing 120 comprises an aligner shaft 121 and two rider assemblies, each including a positioning means 130. The aligner shaft 121 aligns, spaces apart, and interconnects the spreader means which are transversely disposed thereto. Members of pairs of tensional support lines 124, 125 are attached to the T-shaped spreader seats 122, 123, respectively, at the outer sides of each seat, so that the rope ties are mutually parallel at the fastening positions, and converge upwardly to the support pivots 126, 127, respectively, which in this instance are spaced a greater distance apart than the distance between the fastening positions of the pairs of lines 124, 125, whereby the ropes 124, 125 are outwardly inclined. The rope ties are metal eyes, such as the eyes **124*a* in FIG. 20.**

Figure 18:
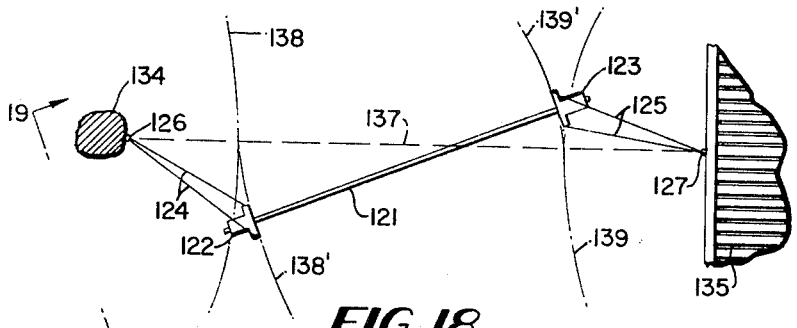
FIG. 18 is a top view of the swing shown in FIGS. 16 and 17 that is suspended between a tree and a porch and is in a transposed position while executing a figure-eight swinging motion.

As a result, the spreader seats 122, 123 tend to follow the arcuate paths 138, 139 in FIG. 18, which are semicircular when viewed from the respective pivots 126, 127 and flattened ellipses when viewed from above. When one spreader seat, while following a spirally downwardly path 139', 138', is at the leading end as the swing 120 dips at maximum angle, such as swing 60'' in FIG. 3, the other spreader seat at the trailing end tends to follow a spirally upward path 138', 139', respectively, so that the "figure-eight" maneuver is sometimes more readily perceived with reference to a single spreader seat than the entire swing, 120 and the "8" sometimes appears to be steeply inclined.

Figure 19:
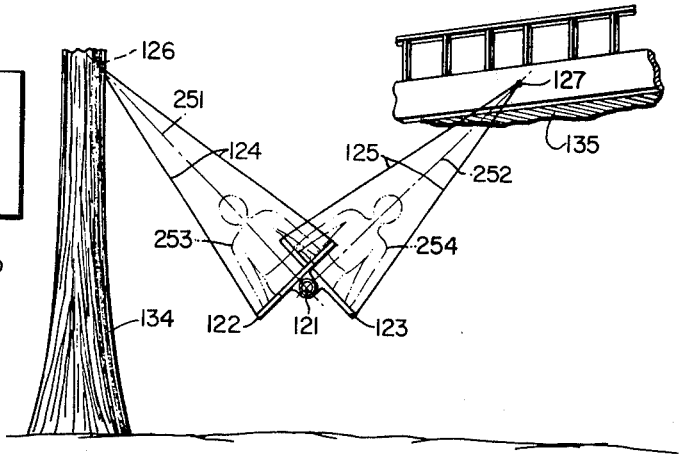
FIG. 19 is an end view of the swing and supporting structures shown in FIG. 18, looking in the direction of the arrows 19—19 in FIG. 18.

In FIGS. 18 and 19, the support pivots 126, 127 are respectively attached to a tree tunk 134 and to a porch 135, and the spreader seats 122, 123 are across the vertically disposed imaginary pivot plane 137 between the support pivots 126, 127, i. e., the swing 120 is transpositionally disposed. The riders 253, 254, who are shown in phantom in FIG. 19 as seated on the respective seats 122, 123, are at all times bisected by the respective imaginary seat planes 251, 252 which longitudinally and perpendicularly bisect the seats 122, 123 and pass through the respective support pivots 126, 127. The planes 251, 252 consequently bisect the respective isosceles triangles formed by the ropes 124, 125 and the seats 122, 123. Similarly, the planes 255, 256 in FIG. 5 bisect the isosceles triangles between the ropes 75', 76', respectively. At all times, both riders 251, 252 are swinging relatively independently of each other in endwise and sidewise movements while generally facing each other. The combinations and permutations of movements and attitudes are consequently numerous during the positional changing attitudes are consequently numerous during the positional changing that figure-eight swinging provides and particularly so if the ropes 124, 125 are outwardly inclined so that seesaw swinging also occurs.

In FIG. 19, the spreader seats 122, 123 are shown at what appears to the observer to be maximum angular disposition, similarly to the spreader bars 73', 74' in FIG. 5, that they attain during fast-moving transpositional swinging, as both ends of the swing apparently move in upward spirals. Rarely, if ever, however, do both ends seem to attain such a 90° orientation while they are at the same elevation, particularly if suspended from outwardly disposed ropes. Usually one end of the swing is lower than the other, so that FIGS. 5 ad 19 represent idealized maximum positions.

The rider assemblies being alike, FIGS. 20 and 21 show the details of the spreader seat 122 and the attaching means and positioning means pertaining thereto only. This rider assembly comprises the spreader seat 122, the strap 128 as part of the attaching means, and the positioning means 130.

The seat 122 comprises a sidewise seat **122*a* and an endwise seat 122*b*. The rider, when seesaw swinging, sits on the outward end of the sidewise seat 122*a* and places his feet against the outward transverse edges of the endwise seat 122*b* as footrests. When seesaw swinging, a footrest or other steadying means, such as a buttocks-shaped depression, can be of great importance, because the rider can very easily slide off a bare seat in almost any direction. For gentle swinging, as preferred by small children, one child can face inwardly while sitting on the seat 122*b*, with the shaft 121 between his dangling legs, and another child can sit sidewise on the seat 122*a*, so that four small children can ride on the swing 120.**

Each seat assembly of the seat-strap swing 120 includes a strap 128 which cooperates with the seat 122 thereabove to form an attachment means. Cooperating therewith is a positioning means 130 which holds the shaft 121 in the selected longitudinal position with respect to the seat 122.

The positioning means 130 comprises an inward restraint cable 131, which is fastened to an inward restraining screw 135, attached to the extremity of the shaft 121, and to a seat retention screw 133, attached to the bottom of the strap 128, and also comprises an outward restraint cable 132, which is fastened to the same screw 133 at one end and to an outward restraining screw 134, attached to the bottom of the shaft 121. The cables 131, 132 must be loose enough to permit the shaft 121 and the seat 122 to turn through at least 45°. This looseness causes a certain amount of unexpected longitudinal movement and sudden arrests of the seats 122, 123 during use of the swing 120, but the sensations are not unacceptable to children, particularly older children of at least ten years of age.

Another monoshaft swing embodiment is described by FIGS. 22, 23, and 24. The seat-collar swing 140 comprises an aligner shaft 141, a rider assembly 142, and a much longer rider assembly 143, these unlike rider assemblies being shown in combination principally to save space. As adjunct means for inducing endwise swinging, an inward handbar assembly 150 and an in-line handbar assembly 160 are mounted above the swing 140 and include the tensional support lines therefor.

The inward handbar assembly 150, illustrated with respect to one end only, comprises the seat lines 151, the support lines 152, the pull rings 153, the handbar lines 154, the pull lines 155, the handbar rings 156, and the handbar 157.

The in-line handbar assembly 160, illustrated with respect to one end only, comprises the seat lines 161, the standup lines 162, the support lines 163, the sitting pull ring 164, the sitdown handbar 165, the standup pull ring 166, and the standup handbar 167.

Fastened between the rings 156, 164 is a side handbar 158, on each side of the side of the shaft 141 and parallel therewith, that is useful for group activity and indeed seems to induce children to lead onto the shaft 141 and balance themselves thereon while grasping the side handbar 158. This swing with both endwise-swing-initiating and sidewise-swing-initiating handbar means is highly suitable for group activity for up to eight children who participate by pushing, riding on the seats, balancing on the shaft 141, and watching by turns. Generally, both rider assemblies are alike and both handbar assemblies are alike but need not be so.

The rider assembly 143, of similar construction to the rider assembly 142, is shown in section in FIG. 24. The spreader seat 144 is attached by any suitable means, such as by adhesives, welding, or integrally molding, to the collar 145 which rotates freely about the shaft 141. A pair of flanges 146, 147 are similarly attached by any suitable means to the shaft 141 and in straddling relationship to the collar 145 so that the seat 144 is rotatably attached to the shaft 141 but is longitudinally restrained.

The extraordinary endwise length of rider assembly 143, as compared to the rider assembly 142, is in itself a seesaw means by which a rider can induce endwise swinging, consequently causing seesaw lifting and falling of the riders if the ropes are outwardly inclined. The rider simply shifts his weight endwise in coordination with the endwise motion of the swing. Clearly, this seesaw means functions like the seesaw ends of the duoshaft swing 80 in FIG. 7. Although a handbar 157, 165, or 167 is more helpful for initiating endwise swinging, such weight-shifting on an elongated rider assembly is sufficient, particularly if the rider simply pulls on the nearby support ropes to initiate an endwise movement in the direction in which he is facing. Consequently, any extension of a rider means outwardly of the rope ties for a sufficient distance to permit a rider thereof to shift his weight in an endwise direction constitutes a seesaw means.

A similar monoshaft embodiment is depicted in FIGS. 25, 26, and 27. The rider assembly 170 comprises a spreader bar 172 as the rider means and spreader means, the collar 173 and welds 174 as the attachment means, and the positioning and retaining means comprising the outward retention cable 175 which is fastened to the screw 176 on the shaft 171 and the inward retention cable 177 which is fastened to the screw 178 on the shaft 171 near the extremity thereof. Both cables are attached to the collar 172 and have sufficient slack to permit a 45° relative movement of the spreader bar 172 and the aligner shaft 171 in either direction.

Support ropes are fastened to the eyes 179. This rider assembly 170 is particularly useful in a rotatable swing for standup operation with a standup handbar assembly such as the inward handbar assembly 150 if equipped with a handbar at chest height, such as the standup handbar 167, because of its small mass and suitability for standing when the rider keeps his feet against the eyes 179.

An additional rider assembly for a monoshaft swing is described in FIGS. 28, 29, and 30. This rider assembly 180 is fastened to the aligner shaft 181 by a pulley positioning means 190. The rider assembly 180 comprises the spreader bar 182, the seat 183, the alignment members 184, the footrest 185, and the holding strap 186. Each of these six components cooperates to maintain the shaft 181 positioned rotatably beneath the seat 183. The rope ties 187 at each end of the spreader bar 182 are holes, through each of which a rope, cable, chain, or other suitable tensional support means may be attached.

The pulley positioning means 190 comprises the outward retention cable 191, the alignment member retention screws 192 which are attached to the alignment members 184, the outward retention pulley 193, the inward retention cable 194, and the inward retention pulley 195. Both pulleys 193, 195 are attached to the underside of the shaft 181. The cables 191, 194 are attached at each end thereof to the screws 192 and pass through the respective pulleys 193, 195. This positioning means 190 is kept fairly taut, and almost no abrupt arresting sensations are felt by users of a swing which is equipped with this pulley positioning means 190.

A child standing up on this assembly 180 must face backwards, while placing his feet on the spreader bar 182 beside the seat 183, if the swing is equipped with an in-line handbar assembly 160, but he can sit, or stand with slight stooping, if the swing is equipped with an inward handbar assembly 150. Because this rider assembly 180 is particularly suitable for operating between vertically disposed support structures, it is preferred for such installations and is particularly preferred in combination with an inward handbar assembly 150 for each end thereof. The assembly 180 is especially satisfactory for smaller children who generally prefer to sit down and have well-supported feet while firmly grasping a handbar 157.

The rider assembly 220 shown in FIG. 34 comprises a T-shaped spreader seat 222 having an integrally molded shaft tunnel 223 therebeneath which has an open inner end 225 and a closed outer end 224 as a combined attachment means and partial position means. The end of the aligner shaft fitting rotatably thereinto is preferably equipped with a shock-absorbing means to absorb endwise bumps. The closed outer end 224 of the shaft tunnel 223 functions as the inward part of the position means; a cable, which can be a resilient tensile means such as a spring or elastomeric strip, is fastened to the inward edge of the spreader seat 222 or to the bottom of the shaft tunnel 223, for example, and to the aligner shaft (not shown in FIG. 34) as the outward part of the position means, i. e., it prevents the rider assembly 220 from sliding outwardly along the aligner shaft. Alternatively, a coaxial cable can be attached within a terminal recess, as in FIG. 37, or can be within a hollow shaft, as in FIGS. 39–42.

In FIG. 35, the rider assembly 240 is shown in a top perspective view. It comprises the spreader seat 242 and the shaft tunnel 243. The tunnel 243 is molded centrally into the seat 242, forming a crotch ridge 248 which projects endwise above the surface of the seat 242. The shaft tunnel 243 has an open inner end 245 and a closed outer end 244. Buttocks depressions 246 straddle the crotch ridge 248, have drainage openings therein, and possess a roughened surface. At the outward corners of the seat 242 are the rope ties 247, whereby the support ropes clear the rider. This rider assembly 240 is highly preferred in combination with an inward handbar assembly 150 and is particularly suitable for use between vertically disposed obstacles, such as the walls 65, 66 or the trees 81, 82, 134, because the riders of the spreader seat 242 are protected from contact with such potentially dangerous objects.

DESCRIPTION OF THE FRACTIONAL-SHAFT SWINGS

Figure 36:
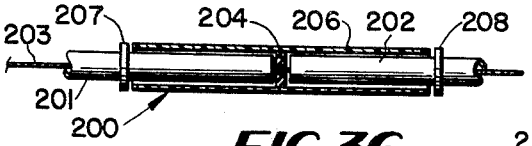
FIG. 36 is a side view of a sectional aligner shaft comprising a pair of hollow shafts, each attached to a rider assembly and having a washer member rigidly attached in circumposed relationship, a hollow connecting shaft freely disposed around both shafts, and a coaxial cable, attached at each end to a rider assembly, which passes through both rider shafts.
Figure 37:
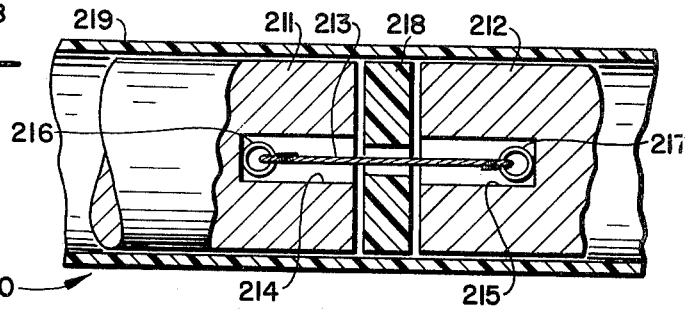
FIG. 37 is a view in section of another sectional aligner shaft comprising a pair or rider shafts, each attached to a rider assembly (not shown), separated by a thick shock-absorbent disc, connected in coaxial recesses by a short cable, and aligned by a freely circumposed outer pipe limited in endwise movement by a pair of washer members (not shown), as in FIG. 36.

FIGS. 36-38 show three fractional-shaft embodiments, each having three shaft-type components as the aligner means. FIGS. 36 and 37 illustrate outer-shaft stiffening, and FIG. 38 illustrates inner-shaft stiffening.

Referring particularly to FIG. 36, two hollow shafts 201, 202, such as aluminum or fiberglass pipe members, which may be loosely or rigidly attached to respective rider assemblies (not shown), abut against a disc 204 having a central hole therein through which a coaxial cable 203 passes, the shafts 201, 202 being interconnected and stiffened with an outer hollow shaft 206 which is limited in endwise movement by means of a pair of washers 207, 208, which are rigidly attached to he respective shafts 201, 202. The disc 204 is suitably fashioned of an elastomeric material, hard-surfaced wood, or a low-friction polymeric material, for example. The shafts 201, 202 must fit very freely and loosely within the shaft 206.

Referring particularly to FIG. 37, two solid shafts 211, 212 have coaxial recesses 214, 215 into which centrally located eyes 216, 217 are fastened. These eyes 216, 217 are connected by means of a short cable 213 and are separated by an elastomeric disc 218 having a central hole through which the cable 213 passes. This disc 218 can be in two pieces which are adhesively conjoined after attachment of the cable 213. The shafts 211, 212 are interconnected and stiffened with an outer hollow shaft 219 which is preferably limited in endwise movement by means of a pair of washers (not shown) as shown in FIG. 36.

Referring specifically to FIG. 38, two hollow outer shafts 236, 237a surround a solid inner shaft 238 and abut against a disc 239 which is circumannularly attached to the shaft 238. To a centrally fastened eye 232 each outward end of the shaft 238, a cable 233 is fastened; the other end of this cable is attached to a bolt, eye, or similar device 234 beneath a seat 231 and embedded in a block 236 for added strength and rigidity. A spreader bar 235 underlies and is rigidly attached to the seat 231 and block 236. The shafts 237, 237a in the nature of an elongated collar, may or may not be rigidly attached to each seat 231 which preferably comprises an integrally molded backrest.

DESCRIPTION OF SWINGS HAVING A HANGER MEANS

FIGS. 39–42 show two rotatable monoshaft swings, each comprising a hanger means. These swings are similar to the duoshaft swing 280 illustrated in FIGS. 31–33 in that stability against revolving of either rider into an upside-down position is provided by fastening a single tensional support line, at a point above the rider's center gravity, to a hanger means which is pivotably movable only, i. e., arcuate movement of its fastening position (rope tie) is parallel to the aligner means. Of course, the higher that the rope tie is located, i. e., the greater the length of the hanger means, the more stable the swing becomes; more exactly, the more closely does the seat remain perpendicularly disposed to the respective plane that bisects that seat and passes through the nearer of the support pivots. Therefore, the hanger means should be cnsiderably longer than needed to place its rope tie above the rider's center of gravity. Twice this length is highly preferred.

Figure 40:
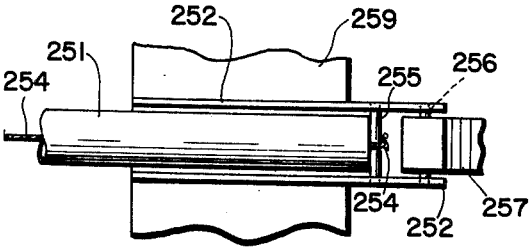
FIG. 40 is a bottom view of the rider assembly of FIG. 39 with the bottom member removed to show its central portion.

Referring particularly to FIGS. 39 and 40, a rider assembly 250 is rotatably attached to a hollow aligner shaft 251 which is positioned by means of a coaxially disposed cable 254 and a transversely disposed bolt 255 to which the cable 254 is fastened. A box-like attachment means, within which the shaft 251 is freely rotatable, is created by the pair of alignment boards 252, the seat 259, and the bottom board 253. The seat 259 could easily be used as a spreader seat by installing rope ties at its ends. Instead, the hanger beam 257 is pivotably attached to the alignment boards 252, at the outward ends thereof, by means of the axle 256. Its rope tie 258 is at least as high as the rider's center of gravity for attachment of a yoke **258*a* and chain 258*b***.

Figure 42:
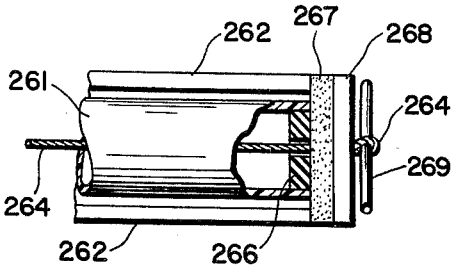
FIG. 42 is a partial bottom view of the shaft in the rider assembly of FIG. 41 in its normal abutting relationship to an elastomeric pad which adjoins the end member of the alignment box through which the cable extends for fastening, with part of the shaft broken away to show its adhesively secured wooden centering block.

Referring particularly to FIGS. 41 and 42, a rider assembly 260 is rotatably attached to a hollow aligner shaft 261 which is positioned by means of a coaxially disposed cable 264 and a transversely disposed rod 269 to which the cable 264 is fastened. The shaft is attached by means of a box-like attachment means comprising the pair of alignment boards 262, the bottom board 263, the pair of top straps 265, and the end member 268 having an elastomeric pad 267 attached thereto. The end of the shaft 261 abuts against this pad 267 in order to minimize shocks. As shown in FIG. 42, the end of the shaft 261 is closed with an adhesively secured wooden block 266 having a central hole within which the cable 264 passes.

The seat 271, having an integrally molded backrest **271*a*, is not needed to retain the shaft 261. The pair of upwardly projecting lugs 262*a*, in front of the seat 271, form a pivot-permitting means for the hanger beam 275 which has a handle 277, at its ropetie level, to which a yoke 278 is pivotably attached. A chain 279 is fastened to the yoke 278. A pull rope 279*a* is also fastened to the handle 277** as an endwise-swing-inducing means, being fastened to the handle on the hanger beam in front of the opposing seat.

Beneath the bottom board 263, footrest members 272, 273 are rigidly attached. A footrest 274 is rigidly attached to the member 272, whereby a rider, particularly a younger rider, can ride comfortably and with exceptional security.

The rider assemblies described hereinbefore can be combined as desired with the inward handbar assembly 150 or the inline handbar assembly 160, as a means for inducing endwise swinging by the riders, or with the side handbar 158, as a means for inducing sidewise swinging by the group players of the rotatable swing of this invention. Further, any of the rider assemblies can be combined with an aligner means that is monoshaft, multishaft, or sectional-shaft to the extent that the dimensions and strength requirements of the components permit. Although the pull rope 279*a* substitutes for a handbar assembly, either rider assembly 250, 260 having a hanger means can be used with a handbar assembly.

The rotatable swing of this invention is suitable for use with inwardly, vertically, or outwardly disposed ropes and is even useful when the closely disposed support pivots 53, 54 are merged into a single pivot for the entire swing, whereby the swing is rotatable as a whole into a twisting and successively untwisting means for creating dizziness while undergoing various permutations of combined sidewise and endwise swinging.

The principles and various structural embodiments of this invention have been disclosed in sufficient detail hereinbefore to permit any person skilled in the swing art to construct a rotatable swing and for children to make use thereof.

Because it will be readily apparent to those skilled in the art that innumerable variations, modifications, applications, and extensions of these embodiments and principles can be made without departing from the spirit and scope of the invention, what is herein defined as such scope and is desred to be protected should be measured, and the invention should be limited, only by the following claims.

What is claimed is:

1. A swing for two riders which is suspendable from a pair of opposed pivots and comprises a pair of rider assemblies and an aligner means for rotatably interconnecting and aligning said rider assemblies in spaced-apart relationship, each said rider assembly of said pair of rider assemblies comprising a stabilizer means for enabling one said rider on one said rider assembly to remain substantially perpendicularly disposed at all times to a longitudinally bisecting plane passing through the nearer of said pivots, whereby said swing is simultaneously swingable endwise, sidewise, and transpositionally.

2. The swing of claim 1 wherein each said rider assembly comprises a spreader bar transversely crossing said aligner means and a double-collar joint as an attachment means for attaching said rider assembly to said aligner means.

3. The swing of claim 1 wherein said aligner means is a single aligner shaft and each said rider assembly comprises a spreader seat having a surface for seating a rider and a shaft tunnel which is molded centrally into said seat, forming a crotch ridge which projects endwise above said surface.

4. The swing of claim 3 wherein said shaft tunnel has an open inner end and a closed outer end.

5. The swing of claim 4 wherein buttocks depressions straddle said crotch ridge and a rope tie is disposed in each outward corner for attaching one of said tensional support lines.

6. The swing of claim 1 wherein said aligner means is a plurality of substantially parallel and adjacent aligner shafts and each said rider assembly further comprises an attachment means for attaching said rider assembly to said aligner means and a position means for maintaining said rider assemblies in said spaced-apart relationship, said stabilizer means comprising a transversely disposed spreader bar at each end of said shafts, and said position means in combination with said attachment means comprising:

A. a pair of spreader discs on each said spreader bar which straddle each said shaft and are flatly adjacent thereto;

B. an endless cable wrap which circumwraps each said shaft between each said pair of spreader discs and further circumwraps said spreader bar passing therebeneath; and C. a pair of cable-retention ridges which straddle each said cable wrap atop each said shaft.

7. The swing of claim 6 wherein said plurality is an odd number of said aligner shafts.

8. The swing of claim 1 wherein said aligner means comprises a pair of aligner shafts and each said stabilizer means comprises a spreader bar.

9. The swing of claim 8 wherein said stabilizer means comprises a hanger means extending upwardly for providing a rope tie which is higher than the center of gravity of a rider thereon, said hanger means being pivotably attached to said swing so that its arcuate movement is parallel to said aligner shafts.

10. The swing of claim 9 wherein said hanger means comprises a triangular hanger bar attached along one side to a pivot tube that is pivotably attached to said spreader bar, said rope tie being at the opposite corner of said triangular hanger bar thereto, for pivotal movement in parallel to said shafts.

11. The swing of claim 10 wherein each said rider assembly further comprises an attachment means for attaching each said aligner shaft to said spreader bar, said attachment means comprising a double-collar joint connecting each said aligner shaft to each said spreader bar.

12. The swing of claim 11 wherein each said rider assembly further comprises position means for maintaining said rider assemblies in said spaced-apart relationship, each said position means comprising a collar and a flanged insert in straddling relationship to each said double-collar joint.

13. The swing of claim 1 wherein said aligner means comprises a hollow aligner shaft.

14. The swing of claim 13 wherein each said rider assembly further comprises a position means for maintaining said rider assemblies in said spaced-apart relationship, each said position means comprising a coaxial cable which is coaxially disposed within said hollow aligner shaft.

15. The swing of claim 14 wherein said aligner means comprises two said hollow aligner shafts which are coaxially disposed and have said cable coaxially disposed therewithin, the inward ends of said shafts abutting against a disc which is disposed therebetween, said disc having a central hole therein through which said coaxial cable passes.

16. The swing of claim 15 wherein said aligner means further comprises a hollow outer aligner shaft which surrounds, interconnects, and stiffens said two aligner shafts.

17. The swing of claim 16 wherein said outer aligner shaft is limited in endwise movement by a pair of washers which are rigidly attached to said coaxially disposed shafts.

18. The swing of claim 1 wherein said aligner means comprises two solid shafts which are coaxially disposed, each said shaft having a coaxial recess in the adjacent inward end thereof.

19. The swing of claim 18 wherein an eye is centrally located in each said coaxial recess, said eyes being connected with a short cable, and said shafts being separated by an elastomeric disc having a central hole therein through which said short cable passes.

20. The swing of claim 1 wherein said aligner means comprises a hollow aligner shaft.

21. The swing of claim 20 wherein said hollow aligner shaft is a fiberglass pipe member.

22. The swing of claim 20 wherein said rider assembly comprises a spreader seat.

23. The swing of claim 22 wherein said spreader seat has a surface for seating one of said riders and a shaft tunnel, having a closed outer end, into which one end of said aligner shaft fits, said spreader seat being held in position with a cable which is coaxially disposed within said aligner shaft.

24. A swing for two riders in generally facing relationship, comprising:

A. at least one aligner shaft; and

B. a pair of assemblies, each adapted to support a person thereon, which:

1. are disposed on opposite ends of and spaced apart in approximate alignment with said at least one aligner shaft,
2. are independently rotatable with respect to each other and to said at least one aligner shaft,
3. are interconnected by and rotatably attached to said at least one aligner shaft, and
4. each comprise a stabilizer means for limiting revolution of a person on said assembly about an axis substantially parallel to said at least one aligner shaft to less than an upside-down position when said swing is operably suspended from a pair of opposed support pivots.

* * * * *